United States Patent [19]

Betzvog, Jr.

[11] Patent Number: 4,937,717

[45] Date of Patent: Jun. 26, 1990

[54] LIGHTING SYSTEM FOR HAZARDOUS AREAS

[76] Inventor: John M. Betzvog, Jr., 919 NW 56th, Seattle, Wash. 98107

[21] Appl. No.: 204,465

[22] Filed: Jun. 9, 1988

[51] Int. Cl.[5] ..... F21V 25/00

[52] U.S. Cl. ..... 362/310; 362/264; 362/294; 362/295; 362/276; 362/373

[58] Field of Search ..... 362/264, 294, 295, 373, 362/310, 267, 276; 174/47

[56] References Cited

U.S. PATENT DOCUMENTS

| | | | |
|---|---|---|---|
| 3,112,890 | 12/1963 | Snelling | 240/51.11 |
| 3,217,097 | 11/1965 | Pauli et al. | 174/47 |
| 3,375,773 | 4/1968 | Wotowiec et al. | 98/40 |
| 3,675,007 | 7/1972 | Appleton et al. | 240/11.2 E |
| 3,754,133 | 8/1973 | Youdin et al. | 362/267 |
| 3,959,644 | 5/1976 | Dammel et al. | 240/47 |
| 4,142,179 | 2/1979 | Lowndes | 340/321 |
| 4,546,420 | 10/1985 | Wheeler et al. | 362/268 |
| 4,630,182 | 12/1986 | Moroi et al. | 362/294 |
| 4,678,290 | 7/1987 | Welker | 362/267 |
| 4,701,833 | 10/1987 | Bornhorst | 362/299 |

FOREIGN PATENT DOCUMENTS

| | | | |
|---|---|---|---|
| 529341 | 3/1975 | U.S.S.R. | 362/294 |
| 494562 | 2/1976 | U.S.S.R. | 362/294 |
| 575975 | 4/1976 | United Kingdom | 362/294 |

OTHER PUBLICATIONS

Crouse-Hinds 1987 Code Digest.

NFPA 196 "Standard for Purged and Pressurized Enclosures for Electrical Equipment", 1986 Edition.

Appleton NEC 1987 Code Review.

Wide-Lite Hostile Environment Lighting Guide, no date.

*Primary Examiner*—Stephen F. Husar

*Assistant Examiner*—Sue Hagarman

*Attorney, Agent, or Firm*—Ward Brown; Robert W. Beach

[57] ABSTRACT

Conduits having the electric wiring for supplying power to lighting fixtures in an area classified as hazardous by reason of the presence of potentially explosive dust, vapor or gas have unobstructed interior passages for conveying nonexplosive gas under pressure from outside the hazardous area to each fixture. The pressure of gas in the conduit network can be monitored automatically and control mechanism can be provided to shut off the supply of electric power to the fixtures if the pressure falls below a predetermined pressure or a dangerous over-pressure condition occurs. At each fixture, the nonexplosive gas can be discharged along the face of the transparent fixture lens and/or along an exterior surface of the fixture housing to prevent build-up of potentially explosive agents and to cool the housing.

13 Claims, 4 Drawing Sheets

LIGHTING SYSTEM FOR HAZARDOUS AREAS

BACKGROUND OF THE INVENTION

1. Field of the Invention

The present invention relates to the general field of illumination. More specifically, the present invention relates to illumination of areas containing potentially explosive agents which can be in the form of dust, vapor or gas.

2. Prior Art

Illumination of an area containing a potentially explosive agent can be complicated, particularly if the area is quite large and/or a variety of potentially explosive agents may be present. An example of such an area is a hanger for painting commercial aircraft, although similar problems are present in various other areas classified as hazardous.

One approach has been simply to avoid placement of electric lighting equipment in a very hazardous area (Class 1, Division 1, in the terminology of the National Electric Code) which can be achieved by isolating the area containing the potentially explosive agent from the lighting equipment. For example, light can be beamed through windows or transparent panels from a nonhazardous location. In a large open area, the lighting equipment may be placed at a location remote from the source of the potentially explosive agent with increased ventilation to decrease the possibility of ignition or explosion.

If the electric lighting equipment must be placed in the very hazardous area, the conventional solution is to provide lighting fixtures classified as "explosion-proof". Examples of such fixtures are shown in Appleton et al. U.S. Pat. No. 3,675,007, issued July 4, 1972, and Lowndes U.S. Pat. No. 4,142,179, issued Feb. 27, 1979. Such fixtures are not intended to be airtight. Rather, conventional explosion-proof lighting fixtures are designed and located so that the maximum temperature of all exposed parts of the fixtures does not exceed 80 percent of the ignition temperature of the explosive agent present and, recognizing that a malfunction may occur, such fixtures are designed to withstand an internal explosion and allow pressure to be released, such as by escape of burned gases, but at temperatures sufficiently low that external ignition is avoided.

Explosion-proof fixtures are very expensive and may require expensive maintenance and replacement if used in a very hazardous area. In addition, the limitation as to the external temperature still limits the areas in which the fixtures can be used.

SUMMARY OF THE INVENTION

It is an object of the present invention to provide a system for illuminating a hazardous area safely by electric lighting fixtures.

It also is an object to provide such a system in which the fixtures can be located in the hazardous area close to the source of a potentially explosive agent.

An additional object is to provide such a system utilizing conventional heavy-duty fixtures with a minimum of modification, i.e., fixtures which are not necessarily explosion-proof.

Another object is to provide such a system adaptable to prevent buildup of potentially explosive agents on the fixture.

A further object is to provide such a system effective for illuminating a large area which may contain a variety of potentially explosive agents such as a hanger for painting commercial aircraft.

In accordance with the present invention, the foregoing objects are accomplished by providing a lighting system having a network of substantially sealed conduits through which the electrical wiring extends, such conduits being sufficiently large for a flow of clean air through the network into the lamp-containing housing of heavy-duty fixtures. In the preferred embodiment, the fixture housing is substantially sealed and the clean air is exhausted from the housing through a manifold adjacent to the lens. Such clean air can be discharged along the face of the lens as an air curtain and/or along the top surface of the fixture housing to prevent buildup of potentially explosive agents and to cool the exterior of the housing. An automatic control system can monitor the pressure of the air in the conduit network and automatically cut off the supply of electric power in the event of a failure.

DETAILED DESCRIPTION

Figure 1:
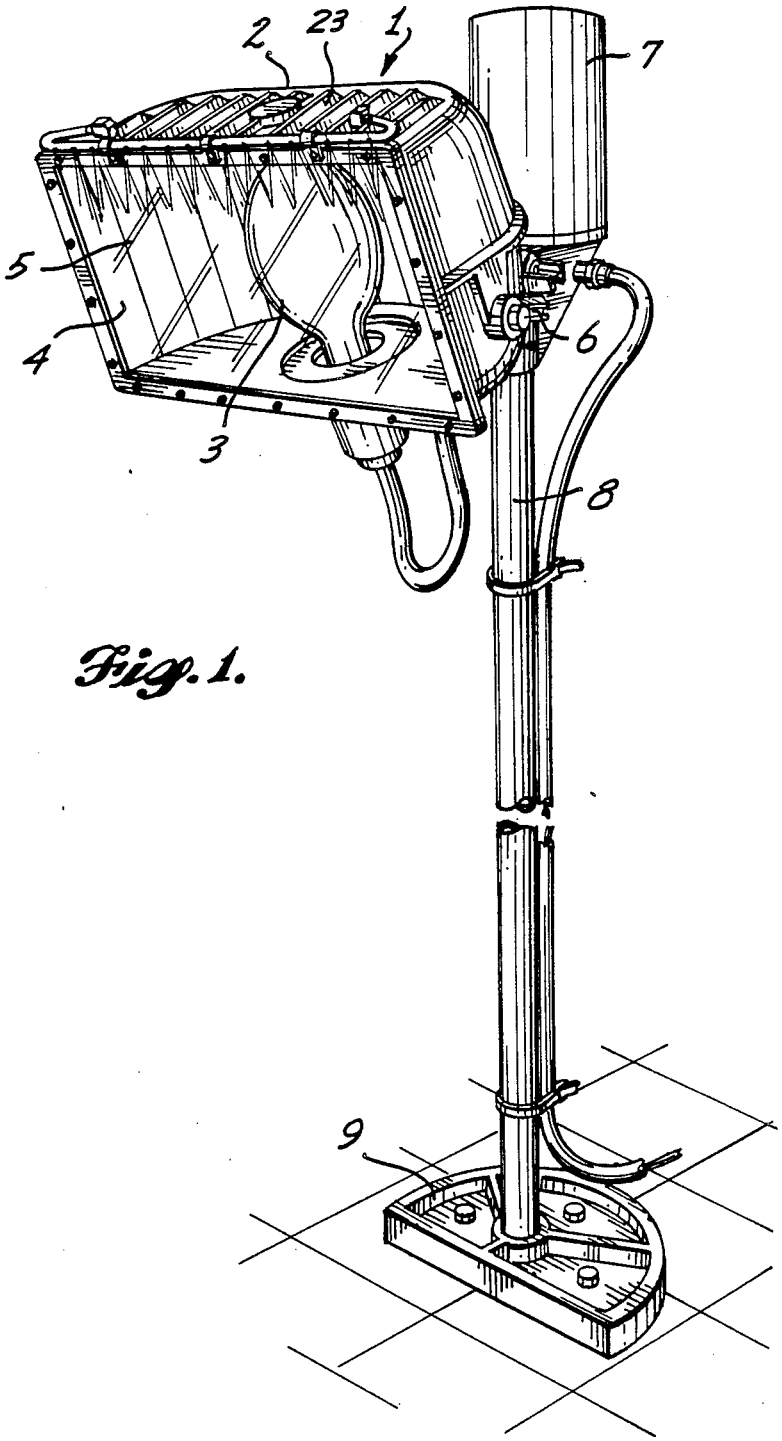
FIG. 1 is a top perspective of an electric light fixture modified in accordance with the present invention for use in a lighting system for hazardous areas.

A representative light fixture 1 of a type usable in a lighting system for hazardous areas in accordance with the present invention is illustrated in FIG. 1. Most components of such fixture 1 correspond to the "MF-HAZ" floodlight available from Wide-Lite of San Marcos, Tex. With slight modifications, the less expensive "F Series" floodlights available from the same company can be used. The MF-HAZ floodlight is approved for use in some hazardous locations, whereas the F Series floodlight is not. Both of such floodlights are designed to be substantially weatherproof and include a substantially airtight lamp housing 2, but neither is an explosion-proof fixture approved for use in the most hazardous areas (Class 1, Division 1).

The fixture housing 2 contains the lamp 3 and rear reflector 4 and has a transparent front lens 5. In a representative installation, the housing is mounted on adjustable yoke arms 6 supported from a ballast casing assembly 7. Such casing assembly, in turn, is mounted on a long upright cylindrical mast 8 extending upward from a heavy base 9.

Figure 2:
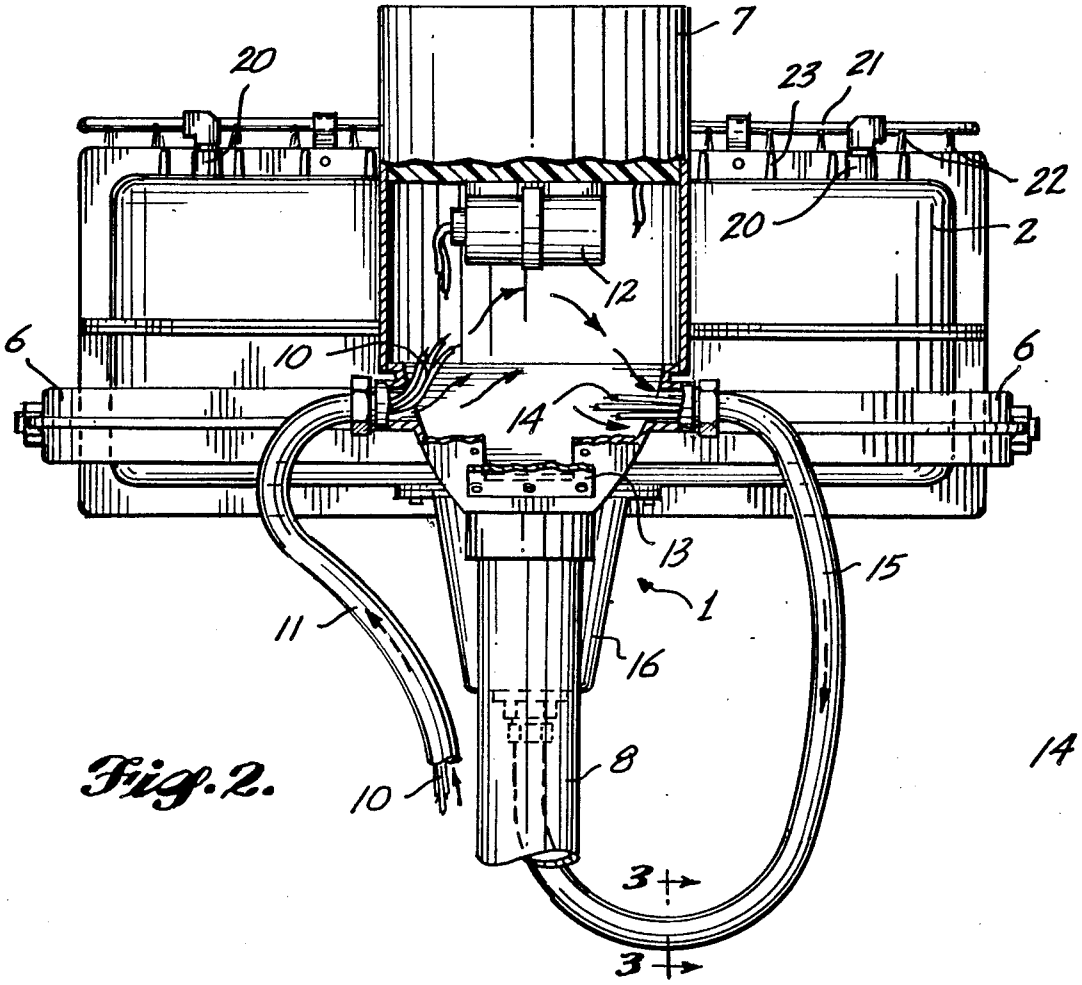
FIG. 2 is a somewhat diagrammatic rear elevation of the upper portion of the lighting fixture of FIG. 1, with parts broken away.
Figure 3:
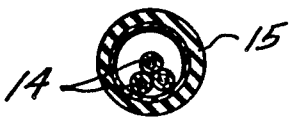
FIG. 3 is an enlarged section along line 3—3 of FIG. 2 showing, in cross section, a conduit of a type usable in the invention.

With reference to FIG. 2, power to the fixture is conveyed by wires 10 extending through a sealed or "sealtight" conduit 11. Such wires extend into the ballast casing 7 which includes among other things the ballast capacitor 12 accessible by a removable access plate 13. The bottom portion of casing 7 is hollow. Power to the lamp is conveyed by wires 14 extending from inside the casing 7 through a conduit 15 identical to the conduit 11. As seen in FIG. 3, conduit 15 is substantially oversized as compared to the size of the wires 14, as is conduit 11 as compared to the size of wires 10. When conventional electrical conduit is used, preferably at least the major portion of the cross-sectional internal area of each conduit is open and unobstructed.

In the MF-HAZ floodlight, the line from the ballast casing to the lamp housing is a sealtight conduit of the type used in the present invention, whereas the wires 10 leading to the casing would normally be encapsulated in a closed cable. In accordance with the present invention, such a closed cable is replaced by the oversized hollow conduit 11 to allow unrestricted flow of nonexplosive gas such as clean air through such conduit. From conduit 11, the gas flows through the hollow interior of the ballast casing 7 and conduit 15 into the lamp housing 2 as represented by the arrows in FIG. 2.

Figures 4, 5:
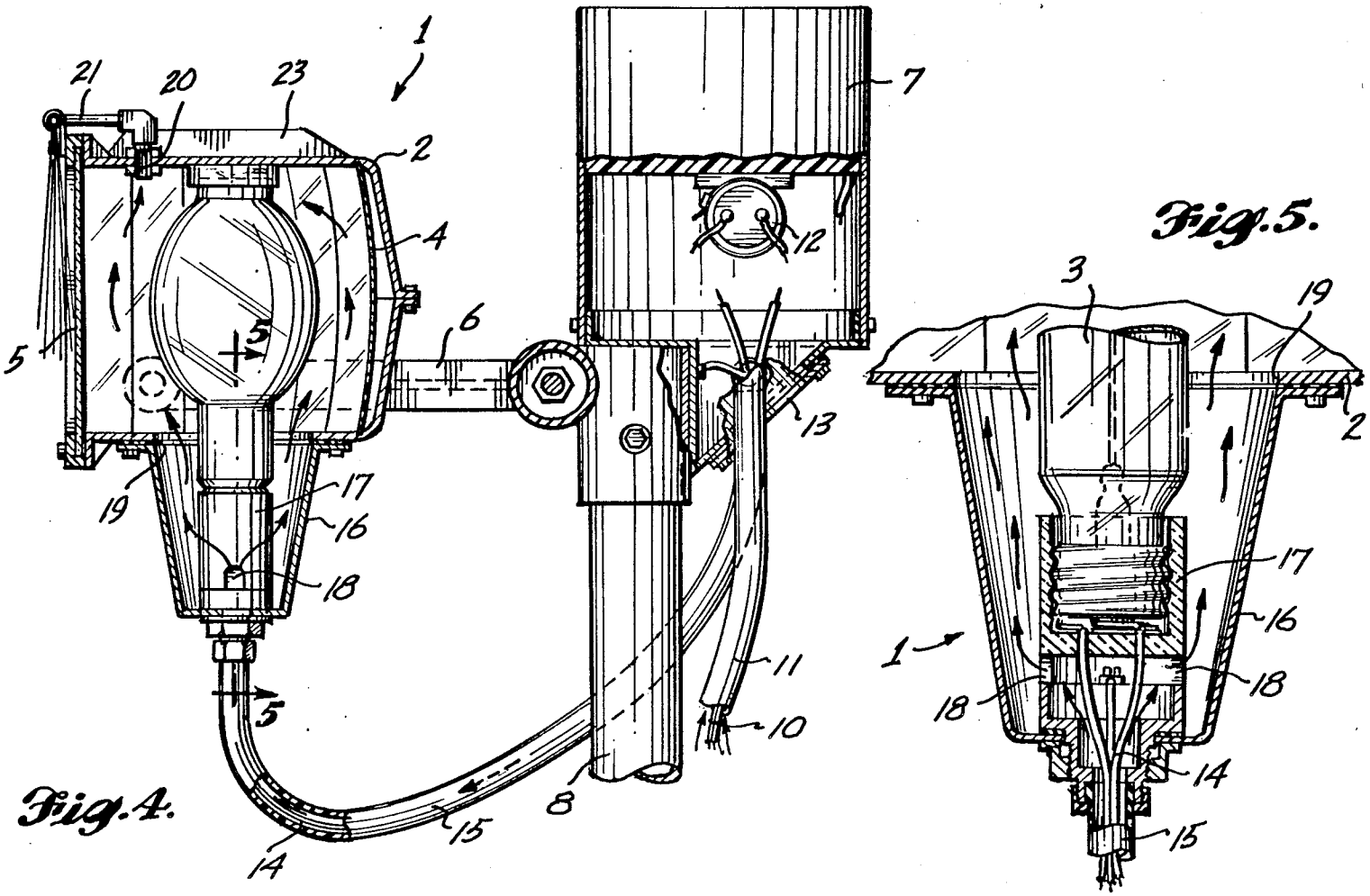
FIG. 4 is a somewhat diagrammatic side elevation of the upper portion of the light fixture of FIG. 1, with parts broken away and parts shown in section.
FIG. 5 is an enlarged section along line 5—5 of FIG. 4.

As best seen in FIG. 5, conduit 15 is sealed to the bottom lamp socket extension 16 of the lamp housing 2. Such extension 16 is detachable from the remainder of the housing for replacement of the lamp 3. There is an unobstructed passage from the interior of conduit 15 alongside the wires 14 to the lamp socket 17 and outward from such socket through slots 18. Gas passing through the slots 18 flows upward through the generally central hole 19 in the bottom of the lamp housing 2 into the upper portion of the housing.

As noted above, the particular fixtures illustrated are designed to be essentially weathertight. Such fixtures have sealed and gasketed connections and joints. In accordance with the present invention, one or more outlets 20 are provided for the gas flowing into the fixture. In the illustrated embodiment, two outlets 20 extend through the top of the fixture housing 2 and lead to a long manifold 21 extending along the upper leading edge of the housing adjacent to the upper edge of the transparent lens 5, as best seen in FIG. 1 Such manifold has a row of closely spaced openings or holes 22 positioned such that the gas leaves the manifold as a substantially continuous curtain blown down along the exterior of the lens 5. In addition, or alternatively, openings can be positioned to discharge gas rearward along the top of the housing 2 which has heat-dissipating fins 23 to assist in cooling the top surface of the housing Typically, the area immediately above and surrounding the upper portion of the lamp is the hottest portion of the fixture and could limit the specific hazardous areas in which the fixture can be used. Blowing air over the lens and/or along the top of the housing also helps prevent buildup of potentially explosive agents or agents which could interfere with light transmission through the lens, such as paint spray. Buildup on the lens can itself increase the danger by absorbing heat and increasing the surface temperature.

Figure 6:
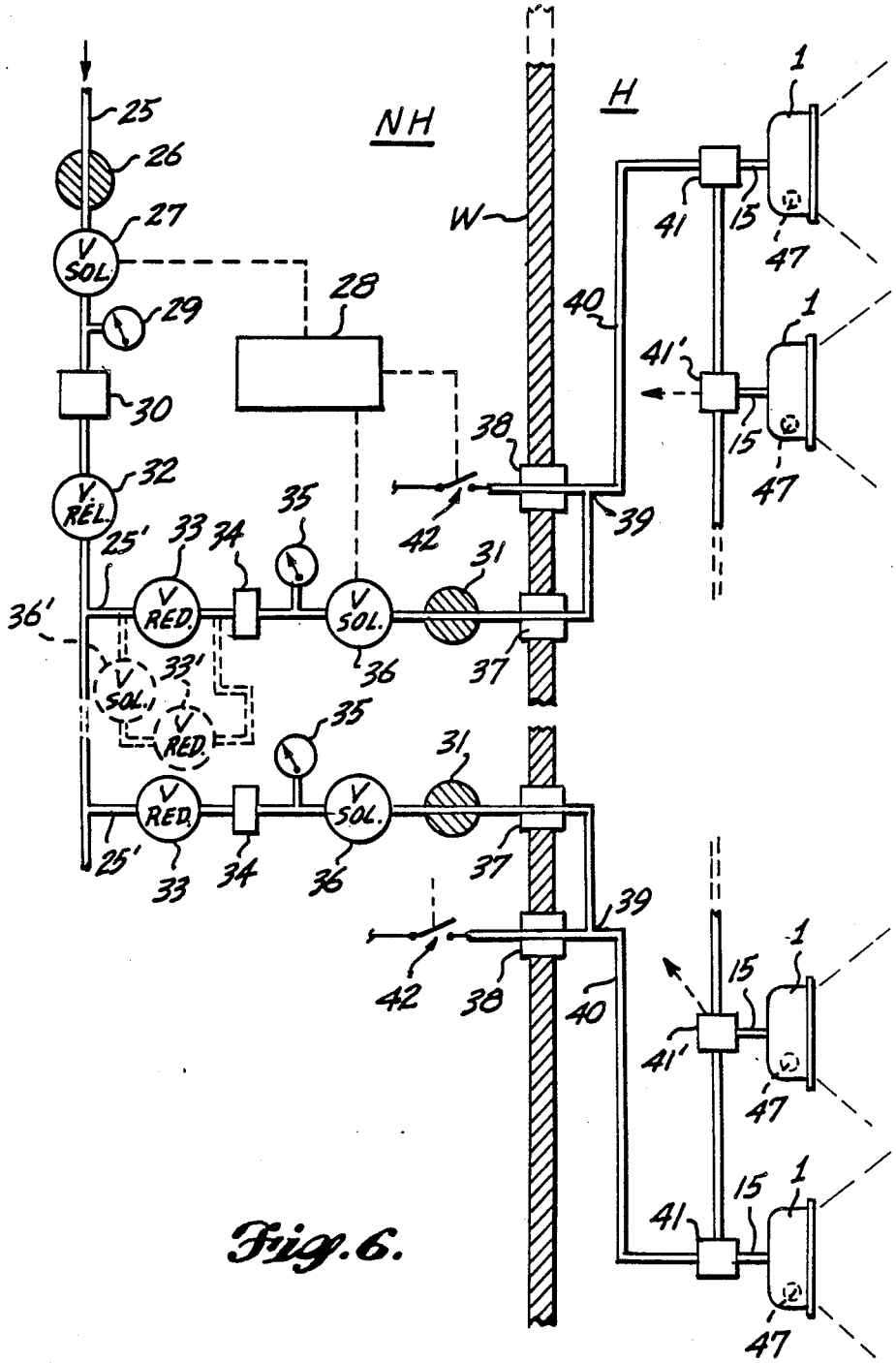
FIG. 6 is a schematic diagram of the gas supply system of a lighting system for hazardous areas in accordance with the present invention.

With reference to FIG. 6, air to be injected through a plurality of the fixtures can be from the source of "factory air" at a manufacturing location such as through a line 25. Preferably, a manually valve 26 is supplied allowing the supply of air to be closed such as for maintenance to the entire system. With valve 26 in its normally open condition illustrated, the air flows to a normally open solenoid valve 27 controlled at a central station such as by conventional electromechanical controls or a microprocessor 28. A pressure gauge 29 can be provided to monitor the pressure of air supplied Typically, factory air is quite dirty and may be humid. For use in the present invention, it is important that the air be clean so that particulates do not collect in or clog any part of the system. Such air also should be dry so that the electrical connections are not exposed to moisture. One or more conventional components 30 can be provided to clean and dry the factory air. Also, to protect the system in case of a substantial overpressure condition, a conventional pressure-relief valve 32 can be used.

From valve 32, the supply line 25 branches to lines 25' each of which leads to a network of fixtures 1 and has a pressure-reduction valve 33. Typically, factory air is at fairly high pressure, such as 100 psi, whereas in accordance with the present invention the clean air is supplied to the fixture at low or moderate pressure, such as 2 or 3 psi above atmospheric pressure. In each branch 25', the air supply line extends from the reduction valve 33 to a conventional rotameter 34 to indicate the flow rate and, if desired, provide a signal indicative the flow rate to the microprocessor 28. Downstream of the rotameter is an additional pressure gauge 35 which, like gauge 29, also can supply a signal to the microprocessor. In each branch 25' leading to the individual light fixtures 1, an additional solenoid valve 36 is used, preferably controlled by the microprocessor 28, and an additional manual valve 31 is provided to be closed, for example, if only one branch of the lighting system requires maintenance.

Preferably, all of the air supply components described above are located in the nonhazardous area NH which, for the purposes of illustration, is indicated to be to the left of a wall W in FIG. 6, as compared to the hazardous area H to the right of such wall. The branch supply lines 25' have externally sealed joints or fittings 37 as they extend from the nonhazardous area to the hazardous area.

Within the hazardous area, preferably the air is supplied through the same network of conduits 40 and junction boxes 41 used for the power supply and control wiring. The electrical conduits 40 have joints or fittings 38 which are externally and internally sealed as the conduits enter the hazardous area and the air supply lines are in communication with such conduits through tee fittings 39. The junction boxes 41 preferably are substantially oversized to act as pressure accumulators. From each junction box, a single conduit 15 leads to the ballast casing for the fixture 1, and in each interconnected line of fixtures, preferably at least one junction box 41' contains a pressure sensor and/or rotameter providing a signal to the control mechanism or microprocessor 28. In the event of a substantial loss of pressure or a serious overpressure condition, the supply of electricity to all fixtures within the same branch is automatically cut off, such as by automatically opening a switch 42 in the primary power supply line. Within each branch individual fixtures or banks of fixtures can be controlled by manual switches in series with the appropriate switch 42.

Preferably, the control mechanism or microprocessor 28 also monitors operation of the light fixtures 1 at start-up or restart. Prior to actuation of the lamps, airflow through the fixtures should be sufficient to purge them of any potentially explosive agents which may have leaked into the fixtures. The supply of air through the fixtures can be monitored automatically so that the lamps can be actuated only after a certain period has passed or a certain volume of air has been injected through the appropriate branch, at which time the primary power supply switch or switches 42 can be closed automatically.

Figure 3A:
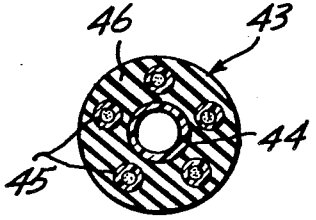
FIG. 3A is a corresponding section of a modified conduit or cable.

In a permanent installation where the positions of the fixtures will not change, the network of standard electrical conduits can be used. For a portable lighting system, however, it may be desirable to provide the modified conduit-cable 43 illustrated in FIG. 3A. Such cable has a central unobstructed hose 44 with the power supply and control wires 45 encapsulated in insulative but preferably somewhat flexible material 46 such as a natural or synthetic rubber which protects the wires and central hose from kinks and breakage, even if the cable is moved and flexed frequently. In most installations, clean and dry air is an acceptable pressurizing and purging medium injected through the hose 44, but in extremely hazardous conditions, inert gas can be used.

With reference to FIG. 6, as an alternative to a system in which gas is continuously injected into and exhausted from each individual fixture 1, each fixture can be provided with a valve 47, diagrammatically indicated in broken lines in FIG. 6, controlled remotely such as by the microprocessor 28. At start-up or restart, the primary power supply switches 42 would be opened and all of the valves 47 would be opened while the system is purged of any possible potentially explosive agents. After a predetermined period or amount of purging airflow through the system, the valves 47 can be closed automatically to pressurize the substantially sealed fixtures 1 and thereby prevent introduction of potentially explosive agents into the fixtures. As in the previously described embodiment, the pressure of the system can be monitored automatically by the control mechanism or microprocessor 28 to cut off the supply of electric power automatically if the pressure is dangerously reduced or increased above design conditions.

Another option is to actuate valves 47 to full open positions for maximum flow at start-up and restart and to close such valves partially after the system is purged to a desired degree for continuous but decreased flow of nonexplosive gas under normal operating conditions.

Still another option is to increase the pressure of nonexplosive gas supplied to the system at start-up or restart for a corresponding increase in the purging gas flow. With reference to the broken line illustration toward the left of the upper branch 26' in FIG. 6, a second reduction valve 33' can be connection in parallel with valve 33 and in series with a second solenoid valve 36'. At start-up or restart, valve 36' can be opened automatically to supply gas to reduction valve 23' in addition to the supply to valve 33. Valve 33' can reduce the pressure of nonexplosive gas to a lesser degree than valve 33, such as 5 to 10 psi above atmospheric pressure. After the desired degree of purging has occurred, the control mechanism or microprocessor 28 can automatically close solenoid valve 36', so that during normal operating conditions all of the nonexplosive gas is fed through reduction valve 33.

In either system, fixtures which are not necessarily explosion-proof can be used, such as substantially sealed heavy-duty fixtures, and the fixtures can be safely located in the hazardous area, even close to the source of a potentially explosive agent. Consequently, the system in accordance with the present invention is adaptable for previously difficult illumination problems such as to provide bright illumination in a paint hanger for commercial aircraft at hard to light locations such as by beaming light from close to the floor underneath the wings and body of the aircraft.

I claim:

1. A lighting system for an area classified as hazardous by reason of possible presence of potentially explosive agents in the ambient atmosphere, said system comprising a plurality of separate lighting fixtures disposed in such ambient atmosphere, each of said fixtures having an internal light-producing electric lamp element and a substantially closed lamp housing separate and spaced from the housings of the other fixture, means for supplying clean, dry, nonambient gas under pressure which nonambient gas is devoid of the potentially explosive agents, a network of closed conduits extending from said supplying means, said conduits having portions extending through such ambient atmosphere to said fixtures, respectively, and having unobstructed interior passages in open communication with the interiors of the housings of all of said fixtures for supplying the clean, dry, nonambient gas under pressure into said fixture housings, and means for regulating the flow of the nonambient gas under pressure form said supplying means into said conduit network for controlling the supply of such nonambient gas to all of said housings of all of said fixtures.

2. The lighting system defined in claim 1, in which each of the fixture housings has an outlet for the nonambient gas, the regulating means including valves for closing and opening said outlets and automatic control means for controlling opening and closing of said valves.

3. The lighting system defined in claim 1, including power supply wiring for conveying electrical power to the internal lamp elements of the fixtures, said wiring extending along the conduits.

4. The lighting system defined in claim 3, in which the regulating means includes control means for automatically monitoring the supply of nonexplosive gas through said conduit network, said control means including means controlling the supply of electric power to the power supply wiring.

5. The lighting system defined in claim 3, in which a plurality of the fixtures include open gas outlets for continuous exhaust of the nonambient gas from the housings.

6. The lighting system defined in claim 5, in which the lamp housings include transparent lenses and the outlets include means for discharging the nonambient gas from inside the housings adjacent to the exterior faces of said lenses.

7. The lighting system defined in claim 6, in which the outlets include elongated manifolds having closely spaced outlet holes for discharging substantially curtains of the nonambient gas over the exteriors of the housing lenses.

8. The lighting system defined in claim 3, in which the power supply wiring extends through the interior passages of the conduits.

9. The lighting system defined in claim 8, including an interiorly sealed fitting at the location of introduction of the wiring into the conduit.

10. The lighting system defined in claim 8, in which the cross-sectional size of the interior passages of the conduits is at least twice the aggregate cross-sectional size of the power supply wiring such that the portion of the interior passages of the conduits not obstructed by the power supply wiring constitutes the major portion of the interior passages of the conduit.

11. A lighting system for an area classified as hazardous by reason of possible presence of potentially explosive agents, said system comprising a plurality of lighting fixtures each having an electric lamp and a substantially closed lamp housing, a network of conduits having unobstructed interior passages in open communication with the interior of the housings of all of said fixtures, and means for injecting nonexplosive gas under pressure from outside such hazardous area into said conduit network for supply to all of the housings of all of the fixtures, said gas-injecting means including means for supplying the nonexplosive gas at a first pressure for a desired period and, thereafter, at a second pressure different from the first pressure.

12. The process of lighting an area classified as hazardous by reason of possible presence of potentially explosive agents in the ambient atmosphere which comprises disposing in such ambient atmosphere a plurality of separate lighting fixtures each having an internal light-producing electric lamp element and a substantially closed lamp housing separate and spaced from the housings of the other fixtures, interconnecting such fixtures with a network of closed conduits extending from a source of clean, dry, nonambient gas under pressure which nonambient gas is devoid of the potentially explosive agents, such conduits having unobstructed interior passages in open communication with the interiors of the housings of all of the fixtures for supplying the clean, dry, nonambient gas under pressure into the fixture housings, and regulating the flow of the nonambient gas under pressure from such source into the conduit network for controlling the supply of such nonambient gas to all of the housings of all of the fixtures.

13. The process defined in claim 12, including initially supplying the nonexplosive gas to the fixtures at a first pressure and subsequently supplying the gas to the fixtures at a lower pressure.

* * * * *